United States Patent [19]

Rogak et al.

[11] Patent Number: 4,462,179

[45] Date of Patent: Jul. 31, 1984

[54] CHAMBER ALIGNMENT AND SAFETY SYSTEM FOR A FIREARMS

[75] Inventors: Michael Rogak, Antioch; Charles Witbeck, Mundelein; Leonard W. Golan, Winnetka; Stephen L. Golan, Chicago, all of Ill.

[73] Assignee: Hawk Industries, Inc., Northfield, Ill.

[21] Appl. No.: 290,606

[22] Filed: Aug. 6, 1981

[51] Int. Cl.[3] ..... F41C 11/00; F41C 11/02; F41C 17/00

[52] U.S. Cl. ..... 42/1 Q; 42/13; 42/70 R

[58] Field of Search ..... 42/1 Q, 16, 13, 70 R

[56] References Cited

U.S. PATENT DOCUMENTS 3,411,405 11/1968 Pachmayr et al. ..... 42/1 Q

*Primary Examiner*—Charles T. Jordan
*Assistant Examiner*—Ted L. Parr
*Attorney, Agent, or Firm*—Martin Faier

[57] ABSTRACT

A chamber alignment and safety system for firearms consisting of longitudinally extending slide mechanism axially aligned with and pivotally connected to the barrel and bolt housing, said slide mechanism including means for moving said pivotal connections away from one another, whereby the breech may be opened to expose the chamber for loading ammunition therein and for unloading spent cartridges therefrom by separating and rotating the barrel relative to the bolt housing, and a safety device having a rack carried by the bolt assembly and a pinion gear secured in the bolt housing meshed with the rack for driving the bolt assembly into and away from firing alignment with the chamber, said safety device also having trip means connected to a trigger sear for locking and unlocking said sear in triggering position responsive to movement of said rack and gear. This invention also includes a self-adjusting head space block for urging the bolt assembly into firing alignment with the primer cap of a cartridge inserted into the chamber.

14 Claims, 16 Drawing Figures

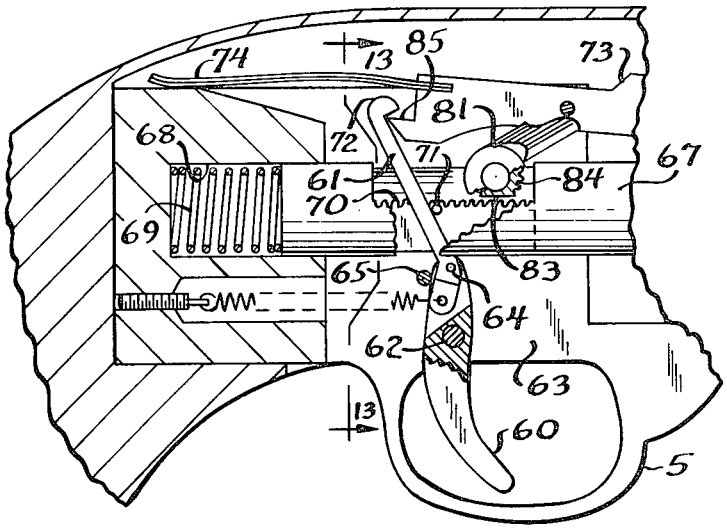
FIG. 12
FIG. 14
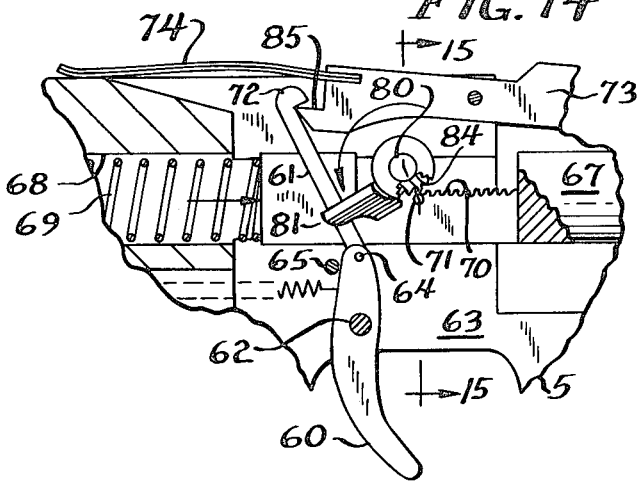
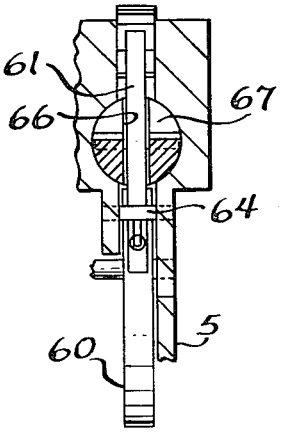
FIG. 13
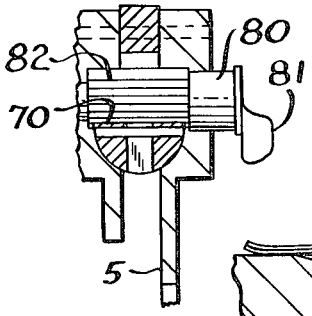
FIG. 15
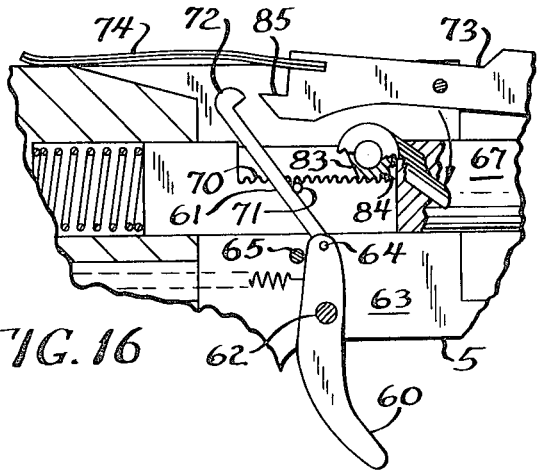
FIG. 16

CHAMBER ALIGNMENT AND SAFETY SYSTEM FOR A FIREARMS

BACKGROUND AND SUMMARY OF THE INVENTION

This invention relates to firearms and is more particularly directed to a chamber alignment and safety system for such equipment.

Conventional firearms, such as shotguns, may break for loading and unloading by pivoting the barrel downwardly relative to the bolt housing, thereby exposing the chamber. In the present invention, a slide mechanism connecting the barrel and bolt housing is provided and the barrel may be moved axially a short distance away from the bolt housing and twisted out of its normal plane to expose the chamber for loading and unloading. In other loading systems, cartridges may be automatically moved into the bore by spring or other action, but the size of the cartridge or its holding member is a limiting factor in such a system, and such an automatic system normally can not be used where separate chambers and firing means are employed. In the loading system embodying the present invention, the firearm may be loaded and unloaded conveniently in minimum space, while the prior art shotgun-type loading system requires space for the barrel to swing downwardly, and usually must be loaded when the user is in a standing position.

Conventionally, firearms have a safety system which disengages the trigger, locks the bolt or locks the firing pin mechanism, but sometimes, particularly during loading or unloading, the safety is unintentionally moved or the parts intended to be locked go out of locked alignment, permitting the safety to become ineffective or unlocked, thus allowing unintended discharge of the gun. In the present invention, the safety is positively locked, not only by withdrawing the bolt assembly from the firing position and withdrawing the firing pin from the firing position, but also by disengaging the trigger sear from its triggering train. Furthermore, the location and structure of the novel safety mechanism is on the side wall of the bolt housing above the trigger and its positive connection to the bolt and trigger sear through a gear and rack formed on the bolt extension, which is released when in firing position, prevents unintended disengagement of the safety mechanism or disengagement due to misalignment of parts.

Conventionally, the face of the bolt has a depression at the chamber designed to accommodate the cap primer end of a cartridge or shell, and normally, the firing pin is intended by spring action to contact the primer cap through the bolt face. However, where the firing pin bolt face or chamber becomes out of line due to wear, or inaccuracy of manufacture, or there is a variance in the position of the primer cap of the ammunition used, a misfire may result and the necessary firing contact of the firing pin on the ammunition primer cap may not occur. In the present invention, the front portion of a conventional bolt or breech-block is removed and a novel spring loaded bolt face, through which the firing pin travels, is employed. This spring loaded bolt face has a large spring, one end of which bears against the bolt block and the other end of which bears against the rear side of the novel bolt face, and the spring is constructed to permit the firing pin and any of its auxiliary structure to pass axially through the bolt face spring and bolt face. The other face of the bolt face or head space device has a depression for receiving the primer end of the ammunition, and this device applies constant spring pressure on a cartridge in the chamber to maintain it centered and held in place in the chamber relative to the firing pin. This novel bolt face device is contained in the bolt housing.

OBJECTS AND ADVANTAGES OF THE INVENTION

It is the object of the invention to provide a chamber alignment and safety system for firearms of the character referred to.

Another object is to provide a novel breech loading and unloading system characterized by a slide mechanism having pivot connection to the bolt housing and barrel for moving the barrel slightly away from the bolt housing and twisting the barrel out of its normal plane aligned with the bolt housing, thereby exposing the chamber.

Another object is to provide a novel slide mechanism for such a loading and unloading system.

Another object is to provide a novel barrel and bolt housing pivotal connection for a loading and unloading slide mechanism.

Another object is to provide a novel alignment and locking structure for a rotatable and slidable barrel-bolt housing connection for loading and unloading firearms.

Another object is to provide a novel self-adjusting bolt face or head space device for centering, aligning and applying pressure on a cartridge in a chamber positioned for engagement of a firing pin with its primer cap.

Another object is to provide floating action for such a self-adjusting bolt face or head space device.

Another object is to provide a novel spring urged means for moving a self-adjusting head space device against the end of a cartridge seated in a chamber.

Another object is to provide a novel safety device which moves the bolt assembly away from the firing position and locks the bolt assembly, and disengages the trigger assembly.

Another object is to provide a safety device operable through and connected to the bolt housing remote from the trigger for positively disengaging the bolt, including the firing pin assembly, and trigger sear from firing capability.

Another object is to provide a novel rack and pinion gear safety device, which positively locks the bolt, firing pin and trigger assemblies.

Another object is to provide rack means on the bolt assembly meshed with a geared safety lever for moving the bolt assembly into and away from firing position responsive to manipulation of the safety lever.

Another object is to provide means on the rack for engaging and disengaging the trigger sear.

Another object is to provide a pivotally mounted trigger sear adapted for engagement and disengagement with the triggering mechanism of a gun.

Another object is to provide means on a gear for a safety device carried by a bolt assembly for a gun which is freely movable for firing action when the safety is disengaged.

Another object is to provide a breech bolt alignment and safety system for firearms which is relatively simple and inexpensive to manufacture and install in a gun and which is very efficient and safe in use.

These and other objects and advantages of the present invention will become more apparent as this description proceeds, taken in conjunction with the appended claims and accompanying drawings.

BRIEF DESCRIPTION OF THE DRAWINGS

In The Drawings

FIG. 12 is a sectional view of a trigger assembly showing the novel safety device system embodying the invention with the safety device in inactive or firing position.

FIG. 13 is a cross-sectional view taken on line 13—13 of FIG. 12.

FIG. 14 is an enlarged detailed partial cross-sectional view showing the safety device with the bolt assembly moved forward by the safety gear, similar to FIG. 12.

FIG. 15 is a cross-sectional view taken on line 15—15 of FIG. 14.

FIG. 16 is a cross-sectional view of the safety device similar to FIG. 14, showing the trigger sear in inoperative position.

DESCRIPTION OF PREFERRED EMBODIMENTS

Figure 1:
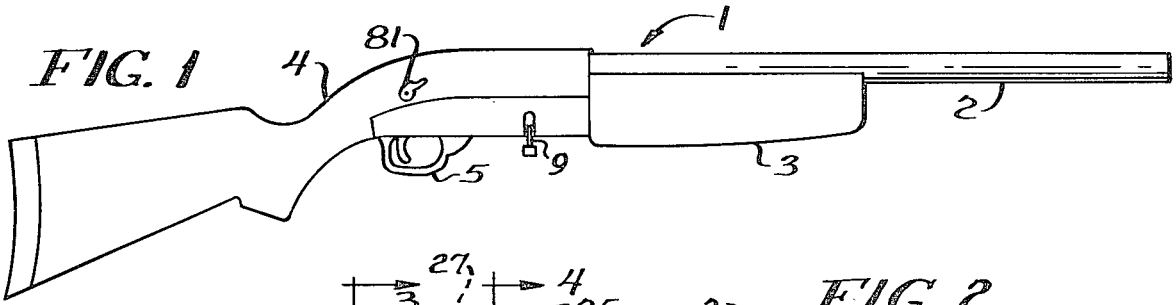
FIG. 1 is a side elevational view of a typical shotgun embodying the present invention.
Figure 2:
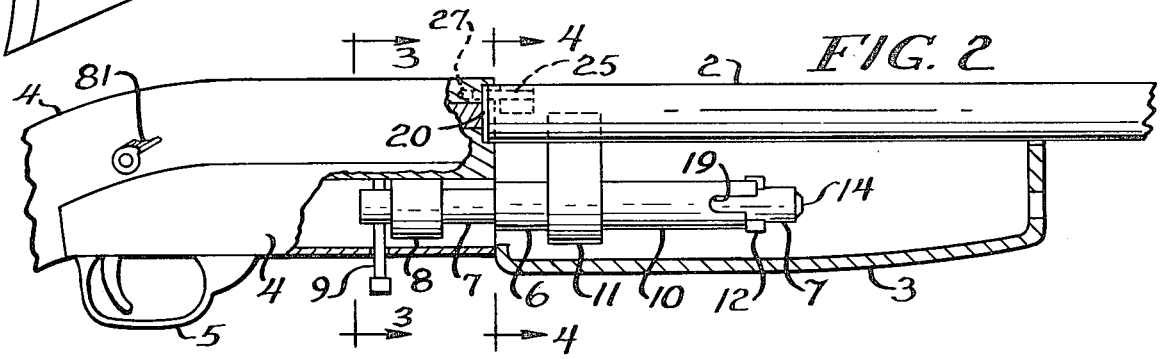
FIG. 2 is an enlarged partial view of the shotgun shown in FIG. 1, the novel breech bolt breaking and pivotal members and slide arrangement being shown in section and in closed position.
Figure 3:
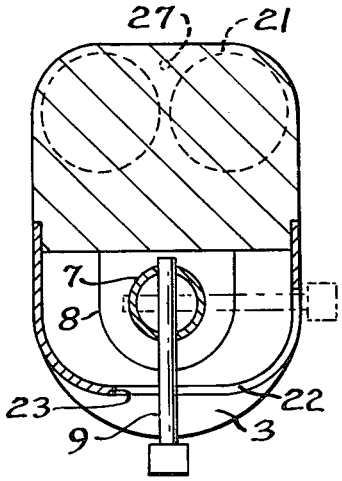
FIG. 3 is a cross-sectional view taken on line 3—3 of FIG. 2.

Firearms, such as a shotgun 1, have a breech portion containing a barrel assembly 2, normally carried by a barrel grip 3, and a bolt assembly, carried by a stock or similar casing 4, which contains a trigger assembly 5 and related firing assembly to be described.

With reference to FIGS. 2–8, the casing has secured therein a slide mechanism 6, which is comprised of an inner slide member 7, rotatably secured in the casing 4 as by a block 8, and having on its end a freely movable operating arm 9, and telescoping into an outer slide member 10 secured in the barrel grip 3 by a block 11. The end of the inner slide member 7 remote from the operating arm 9 has a cross bar 12 which is adjustably secured in a slot 13 by means of a plug 14 threaded into the end of the inner telescoped slide member 7. A fastener 15 is threaded centrally axially through the plug 14 and into the cross bar 12 for holding the cross bar in a selected adjusted position in the slot 13. The large telescoped outer slide member 10 has on its end a circumferential slot 16 disposed between opposed circumferential stops 17 and extending from each stop is a longitudinal slot 19, both slots 16 and 19 being dimensioned to receive therein the cross bar 12, so that the telescoped inner and outer slide members, 7 and 10 respectively, may be moved apart the depth of the slot 19 and rotated in the slot 16 relative to one another the distance between the stops 17, upon manipulation of the movable operating arm 9.

Figure 4:
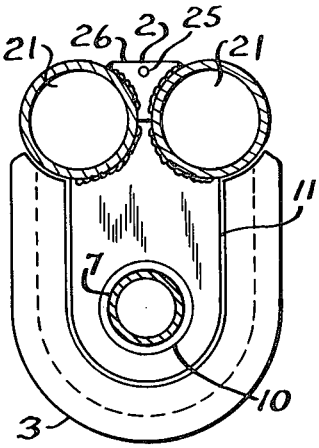
FIG. 4 is a cross-sectional view taken on line 4—4 of FIG. 2.
Figure 6:
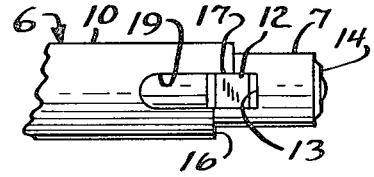
FIG. 6 is a plan view of the slide mechanism adjustment member shown in FIG. 5 in unlocked position.
Figure 5:
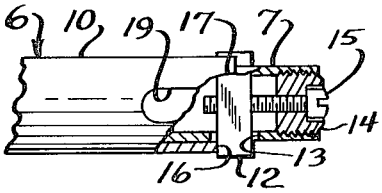
FIG. 5 is a view partially in section of the slide mechanism adjustment member.
Figure 7:
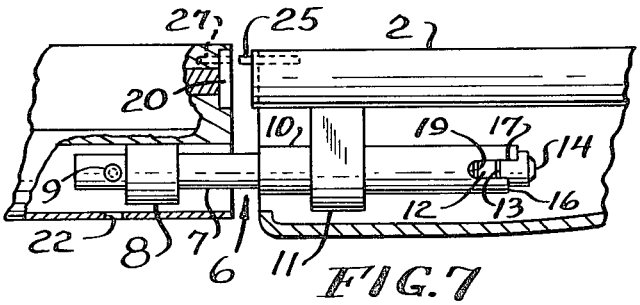
FIG. 7 is a partial section view of the arrangement similar to FIG. 2, except with the slide arrangement member shown in open position.
Figure 8:
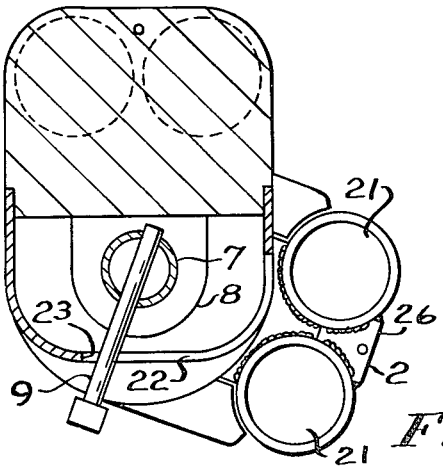
FIG. 8 is a sectional view similar to FIGS. 3 and 4, showing the barrel twisted open pivotally to the bolt housing for loading and unloading.

Thus, to open the breech 20 for loading or unloading one or more of the barrels 21 of the barrel assembly 2, the movable operating arm 9 is manipulated to unlock the slide mechanism 6 and separate the connection blocks 8 and 11 on the inner and outer slide members 7 and 10, respectively, as shown in FIG. 7 and the barrel assembly 2 is then freely rotated on the slide mechanism 6 from the position shown in FIG. 4 to the position shown in FIG. 8. Rotation of the barrel assembly 2 is limited to an arc defined by the slot 22 in the casing 4, the end of which defines a stop 23 for the movable operating arm 9.

A locating pin 25 may be provided on the barrel bridge 26 of the barrel assembly 2 to seat within a locating pin recess 27 in the casing 4 so that the barrel assembly is exactly aligned with the breech 20.

Figure 9:
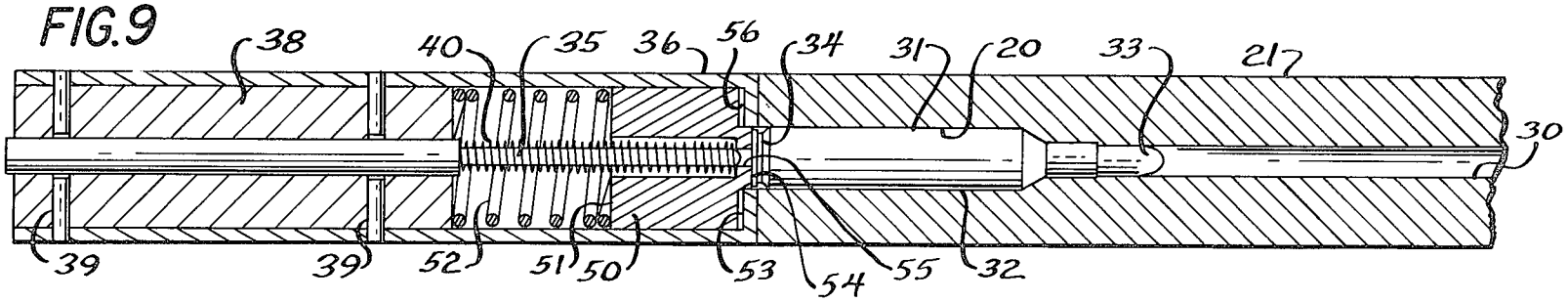
FIG. 9 is an enlarged sectional view of a single barrel firearm chamber and firing pin arrangement having a novel head space or bolt face adaptor device embodying the present invention.
Figure 10:
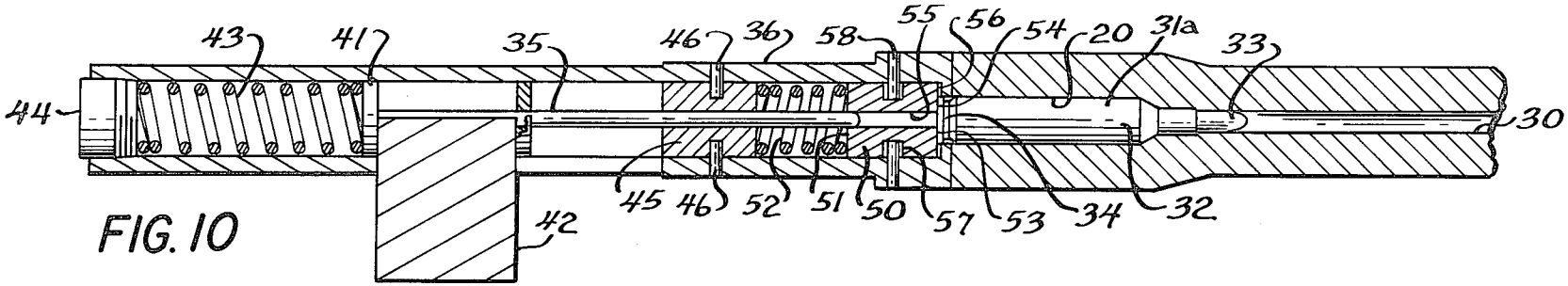
FIG. 10 is an enlarged sectional view of a modified recoil type automatic firearm having a bolt face adaptor device embodying the present invention similar to FIG. 9.
Figure 11:
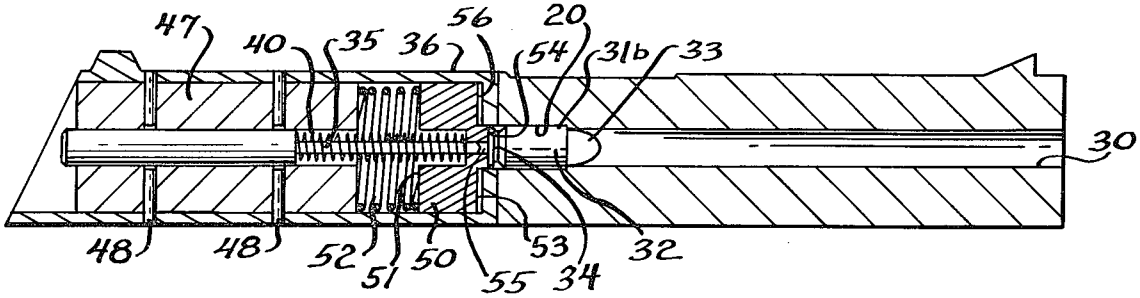
FIG. 11 is an enlarged sectional view of a modified slide type firearm bolt fact adaptor device embodying the present invention similar to FIG. 9.

With reference to FIGS. 9–11, a barrel 21 having a bore 30 and a breech 20 for accommodating ammunition 31, 31*a* or 31*b*, shown in firing position, which comprises a cartridge casing 32 and a cartridge 33 to be expelled therefrom when its primer or ignition cap 34 is struck by a firing pin 35 which travels through the bolt or breech block assembly 36.

The bolt assembly 36 may vary as shown in FIGS. 9–11, depending upon the nature of the weapon, however, all such assemblies have a bolt or breech block assembly through which the firing pin 35 moves. The firing pin 35 may be slidably mounted in a retaining plug 38 held by plug pins 39, as shown in FIG. 9, the forward shank of the firing pin being of reduced diameter and having a firing pin spring 40; or, as in automatic weapons, the firing pin may be secured in a slide member 41 through an operating yoke 42 driven by a spring 43, one end of which bears against the plug 44 and the other end of which bears against a bolt plug 45 and which is connected to the bolt assembly 36 by means of pins 46, as shown in FIG. 10, or the firing pin 35 may be slidably carried through a bolt plug 47 anchored by pins 48 in the bolt assembly 36, as shown in FIG. 11.

In each arrangement shown in FIGS. 9–11, the forward portion of the breech block or slide bolt comprises a bolt face or head space adapter device 50 embodying the present invention. The adapter device 50 has a rear face 51 which carries a spring 52, its other end bearing on the bolt plug 38, 44 or 47. The forward end 53 of the adapter device 50 with the bolt assembly 36 defines an extension or face 54 for accommodating the primer cap 34 of the ammunition axially centrally in line with a channel 55 for the firing pin 35. This adapter device 50 is urged against the ammunition, a space 56 being provided with the bolt assembly 36 to permit limited movement of the adapter device 50. Where the adapter device is pinned into the bolt assembly 36, as shown in FIG. 10, a slot 57 for bolt face pins 58 should be provided in the adapter device 50, to permit its limited movement in the defined space 56. Thus the adapter device 50 exerts constant pressure on the end of the cartridge carrying the primer cap 34 and maintains alignment of the firing pin therewith, irrespective of minor variations in the length of the cartridge, position of the primer cap, or adjustment or wear of the firing pin or bolt assembly relative to one another or to the chamber.

With reference to FIGS. 12–16, the trigger assembly 5 has a trigger 60 connected to a trigger sear 61, the trigger being connected on a pivot by a fastener 62 secured in the trigger housing 63. The end of the trigger 60 is connected to the sear 61 by means of a pin 64 and its pivotal movement is limited by a roll pin 65 secured in the trigger housing 63. The sear 61 extends through a slot 66 in bolt linkage 67 connected to the firing pin assembly (not shown). This bolt linkage 67 is intended to reciprocate in a channel 68 formed in the trigger housing 63, normally urged forward by bolt spring 69.

The bolt linkage 67 has a rack 70 formed on one face thereof and intermediate to the rack is a bridge pin 71 which bears against the trigger sear 61. The hooked end 72 of the trigger sear 61 bears against a shoulder 85 on the firing pin release mechanism 73 when it is rocked downwardly forwardly by pressure from leaf spring 74, one end of which is carried on the trigger housing 63, the firing pin will not operate to discharge the weapon, and this firing pin release mechanism 73 is held in operating position by the trigger sear 61.

Secured for rotation in the housing 63 is a safety device which has a safety lever 81 on the exterior of the trigger housing and a pinion gear 82 is meshed with the rack 70 within the trigger housing. When in operating position the pinion gear 82 is rotated to a point where its flat surface 83 does not mesh with the rack 70, thus permitting free reciprocation of the bolt linkage 67 in the channel 68. However, when the safety lever 81 is rotated so that the teeth 84 on the pinion gear 82 mesh with the rack 70, the bolt linkage 67 is reciprocated rearwardly in the channel 68 out of firing engagement, and, at the same time, the trigger sear 61 is pushed off of the shoulder 85 on the firing pin release mechanism 73, thus rocking the firing pin release mechanism 73 downwardly, under pressure from leaf spring 74, inactivating the firing pin release mechanism 73.

As shown in FIGS. 12 and 13, the safety device is shown in the inactive or firing position, i.e. the teeth 84 on the pinion gear 82 are not meshed with the rack 70, and the bolt linkage 67 is free to move in the groove or channel 68. In this position, pivotal movement of the trigger 60 pulls the trigger sear 61 downwardly, thus moving the firing pin release mechanism 73 downwardly and forwardly to release the firing pin (not shown), returning the firing pin release mechanism to its firing position after each depression of the sear. As shown in FIG. 14, the teeth 84 of the pinion gear 82 may be meshed with the rack 70 by rotating the pinion gear forwardly in the channel 68. In this position the trigger sear 61 becomes disengaged (see FIG. 16) so that the weapon will not fire, because the bolt linkage 67 is disengaged from the firing position. Such disengagement is only temporary and the safety lever 81 may be manipulated to disconnect the gear-rack engagement, permitting the weapon to be fired.

When the safety lever 81 is moved to the position shown in FIG. 16, the bolt linkage 67 is locked in a rearward position in the channel 68 by the mesh of the gear teeth 84 in the rack 70, and the trigger sear 61 has been moved off the shoulder 85, thus fully disabling the weapon, i.e. both the firing pin release mechanism 73 and the bolt linkage 67 being disengaged.

While preferred embodiments of the invention have been shown and described, it is not intended that the invention should be limited to the exact structure shown. The slide and pivoting mechanism shown in FIGS. 1–8 may be utilized in a weapon without providing the bolt face adapter device shown in FIGS. 9–11 or the safety mechanism shown in FIGS. 12–16, and such is the case with each of said improvements in the system described. Accordingly, it is not desired that the invention should be limited, except by the appended claims.

We claim:

1. A self-adjusting head space adapter device for a firearm having a breech portion including a chamber for receiving a cartridge, one end of said cartridge having a primer, and a bolt assembly including a firing pin adapted for striking said primer said head space adapter device being located facing said chamber and comprising: a body, a contact face on said body adapted to bear upon said cartridge end at multiple points surrounding said primer, spring means biasing said body relative to said bolt assembly toward said chamber for causing said body contact face to snugly engage said end and to seat said cartridge in firing position in said chamber, and means aligning said firing pin in striking position with said primer when said contact face is engaged against said cartridge end.

2. The head space adapter device recited in claim 1, wherein said spring means comprises a coil spring surrounding said firing pin.

3. The head space adapter device recited in claim 2, where said firing pin alignment means comprises a channel extending through said body.

4. The head space adapter device recited in claim 2, wherein said firing pin is selectively actuated against said primer by a second spring carried by said bolt assembly separate from said body coil spring.

5. The head space adapter device recited in claim 4, wherein said firing pin has a shaft protected by said body firing pin alignment means when said firing pin is actuated against said primer.

6. The head space adapter device recited in claim 2, wherein said coil spring has sufficient spring pressure to take up slack between said cartridge and chamber and to resist unintended movement away from said chamber when said cartridge is fired upon striking said primer.

7. The head space adapter device recited in claim 1, wherein pin means are engaged in said body to restrain said body against unintended excessive movement in a direction toward and away from said chamber.

8. A self-adjusting head space adapter device for a firearm having a breech portion including a chamber for receiving a cartridge, one end of said cartridge having a primer, and a bolt assembly including a firing pin adapted for striking said primer, said head space adapter device being located facing said chamber and comprising: a body on said bolt assembly facing said chamber, a contact face on one surface of said body for bearing upon said cartridge end at points surrounding said primer, spring means in said bolt assembly bearing upon a portion of said bolt assembly and upon a surface of said body opposed to its said one surface adapted for biasing said contact face in snug engagement with said cartridge end and said cartridge seated in said chamber, and means aligning said firing pin in striking position with said primer when said contact face is engaged against said cartridge end.

9. The head space adapter device recited in claim 8, wherein said head space adapter device is restrained for restricted movement in said bolt assembly by a wall defining an end of said bolt assembly.

10. The head space adapter device recited in claim 8, wherein said spring means comprises a spring having one end thereof bearing against said body and an opposed end thereof bearing against said bolt assembly.

11. The head space adapter device recited in claim 8, wherein said head space adapter device aligning means is axially aligned with said firing pin centrally of said body.

12. The head space adapter device recited in claim 11, wherein said body has a recess on a face thereof opposed to said contact face and axially aligned therewith for receiving therein a spring for said firing pin.

13. The head space adapter device recited in claim 8, wherein said spring means applies equal pressure to said contact face at said points.

14. The head space adapter device recited in claim 8, wherein spring pressure is applied to said contact face by said spring means in a direction coaxial to said breech portion and said firing pin for resisting canting of said cartridge in said chamber.

* * * * *